United States Patent [19]

Lumbis

[11] Patent Number: 4,892,204

[45] Date of Patent: Jan. 9, 1990

[54] AUTOMATIC COUPLER CONTROL SYSTEM

[75] Inventor: Anthony Lumbis, Watertown, N.Y.

[73] Assignee: General Signal Corporation, Stamford, Conn.

[21] Appl. No.: 202,085

[22] Filed: Jun. 2, 1988

[51] Int. Cl.[4] ..... B61G 5/06

[52] U.S. Cl. ..... 213/1.6; 213/1.3

[58] Field of Search ..... 213/1.3, 1.6, 76; 191/11; 280/422

[56] References Cited

U.S. PATENT DOCUMENTS

| | | | |
|---|---|---|---|
| 1,353,557 | 9/1920 | Averill et al. | 213/1.6 |
| 1,412,384 | 4/1922 | Brown | 213/1.6 |
| 1,726,508 | 8/1929 | Van Dorn | 213/1.6 |
| 2,943,213 | 6/1960 | Green | 213/1.6 X |
| 3,263,823 | 8/1966 | Gobrecht | 213/1.6 |
| 3,385,454 | 5/1968 | Jeffrey et al. | 280/422 X |
| 3,646,498 | 2/1972 | Reed | 213/1.3 X |
| 3,914,562 | 10/1975 | Bolger | 191/10 |
| 4,049,128 | 9/1977 | Jeffrey | 213/1.6 |
| 4,129,203 | 12/1978 | Berman | 191/22 C X |

FOREIGN PATENT DOCUMENTS

| | | | |
|---|---|---|---|
| 0576646 | 4/1959 | Canada | 213/1.3 |
| 1267078 | 3/1972 | United Kingdom | 213/1.3 |

*Primary Examiner*—Robert J. Oberleitner
*Assistant Examiner*—Timothy Newholm
*Attorney, Agent, or Firm*—Robert R. Hubbard

[57] ABSTRACT

Coupler control system for railway vehicles that provides isolation of the electric and pneumatic lines of a rail vehicle from its corresponding electric and/or pneumatic intervehicle interface when that end of the vehicle is in an uncoupled condition. A combination proximity sensor and switch is positioned within the mechanical hook coupling housing so as to sense the actual engagement of the mechanical hooks of a pair of vehicles. The switch then closes and becomes operative to initiate a coupling cycle during which the onboard electric and pneumatic lines are coupled to the associated electric and pneumatic interfaces to provide continuity with the vehicle to which it is coupled. Included in the circuitry for the sensor switch is a diode circuit arranged to permit looping of the sensor switch output across the electric interface onto the adjacent car and back through the interface through the use of only two interface connector pins per interface.

4 Claims, 4 Drawing Sheets

AUTOMATIC COUPLER CONTROL SYSTEM

BACKGROUND OF INVENTION

This invention relates to coupling systems for railway vehicles and in particular to a novel and improved system that provides isolation of the electric and pneumatic lines of a vehicle from its corresponding electric and/or pneumatic intervehicle coupling elements as well as from its corresponding battery when required.

Such isolation is required, for example, when the vehicle is uncoupled and/or during coupling and/or uncoupling operations. Isolation may also be required between an onboard battery and a particular circuit line when such circuit line is involved in a train line loop test.

A typical prior art coupling system is the H2C unit of WABCO, Inc. of Wilmerding, Pennsylvania. In this unit, corresponding electric pin connectors of two vehicles are brought into mating electric contact while hot (connected to a source of electric energy). That is, supply voltages and/or signal conditions are actually present on th connectors of one or both of the vehicles. This results in electric arcs across the connectors as they engage during the coupling process or disengage during the decoupling process. The arcs will result in reduced life of the electric interface connectors.

Particularly troublesome in the H2C unit are the battery voltage connectors. Should a vehicle with a live battery to be coupled to a vehicle with a dead battery, the live battery will try to charge the dead battery. This results in a current draw in excess of 75 amperes through the coupler contacts, which if continued for any length of time can result in damage to the coupler contacts. The only way to stop this condition is to uncouple the vehicles or retract the electric coupler portions.

Another prior art coupling system is the Form 73 Coupler Equipment of Ohio Brass Co. of Mansfield, Ohio. This system includes a control mechanism that serves to isolate the electric and pneumatic lines of a vehicle from its corresponding electric and pneumatic interfaces when the vehicle is uncoupled. During a coupling operation the electric coupling contacts upon engagement initiate a coupling cycle. This action causes an electric signal to be generated that, after a three second delay to assure against false signals, is operative to couple the vehicle electric and pneumatic lines to the vehicle's electric and pneumatic interfaces. A problem with the Form 73 Coupler Equipment is that the interface connector associated with the onboard battery power is hot at the time the two electric interfaces come into electric engagement. This results in voltage arcs and, hence, reduced contact life.

A requirement for coupling systems is that the onboard battery be isolated from onboard electric circuits when the vehicle is uncoupled. This has been achieved in the above prior art couplers by routing battery power across the electric interface, through a loop on the adjacent vehicle and then back through the interface. This required a dedication of at least four connectors per electric interface in the Form 73 Coupler Equipment.

BRIEF SUMMARY OF THE INVENTION

An object of the present invention is to provide a novel and improved coupler for railway vehicles.

Another object of the present invention is to provide a novel and improved coupler system that effectively isolates the electric and pneumatic lines of two vehicles from one another until the two vehicles are actually coupled together.

Still another object of the present invention is to provide a novel and improved coupler system that requires only two dedicated connectors per electric interface to achieve onboard battery isolation.

Yet another object is to provide a novel and improved electric system for railway vehicles that isolates onboard battery power of intermediate vehicles from a test loop distributed over a train of such vehicles.

In brief, a coupling system embodying the invention is adapted to railway vehicles in which first and second vehicles have mating mechanical elements for mechanical coupling the two vehicles and electric interfaces for electrically interconnecting the electric onboard conductors of the two vehicles. Each electric interface contains an electric connector in circuit with one of its associated onboard conductors. Corresponding connectors of the two interfaces come into electric contact with one another during a coupling operation. In accordance with the invention, a first switch means is coupled in circuit with the onboard conductors of the first vehicle so as to maintain such conductors in an open circuit when the vehicle is uncoupled. When the mechanical elements of the two vehicles come into actual engagement, an electric signal is produced which is operative to close the first switch so as to provide electric continuity in the conductors of the first vehicle after a delay that allows the connectors of the two interfaces to come into good electric contact during the coupling operation.

In accordance with another feature of the invention, the coupling system is adapted for railway vehicles in which each vehicle has a first electric line adapted for coupling to a battery and a secondary electric line adapted for connection to electric circuits and an electric coupling that interconnects such lines to which the two vehicles are coupled. An electric isolation means is provided for each vehicle so as to isolate the battery of each vehicle from its corresponding second line and electric circuits when the two vehicles are uncoupled while providing electric continuity therebetween when the two vehicles are coupled. This isolation means comprises a diode connected between the corresponding first and second lines with a polarity to isolate the battery from its corresponding second line. The electric coupling elements of the two vehicles mate in the coupling condition so as to provide a connection of the first and second lines of the first vehicles with the second and first lines, respectively, of the second vehicle. Thus, the battery of the first vehicle is coupled to its corresponding second line via the two electric coupling elements and the second line and diode of the second vehicle.

BRIEF DESCRIPTION OF DRAWINGS

In the accompanying drawings, like reference characters denote like elements of structure in the various figures.

DESCRIPTION OF PREFERRED EMBODIMENT

Figure 1:
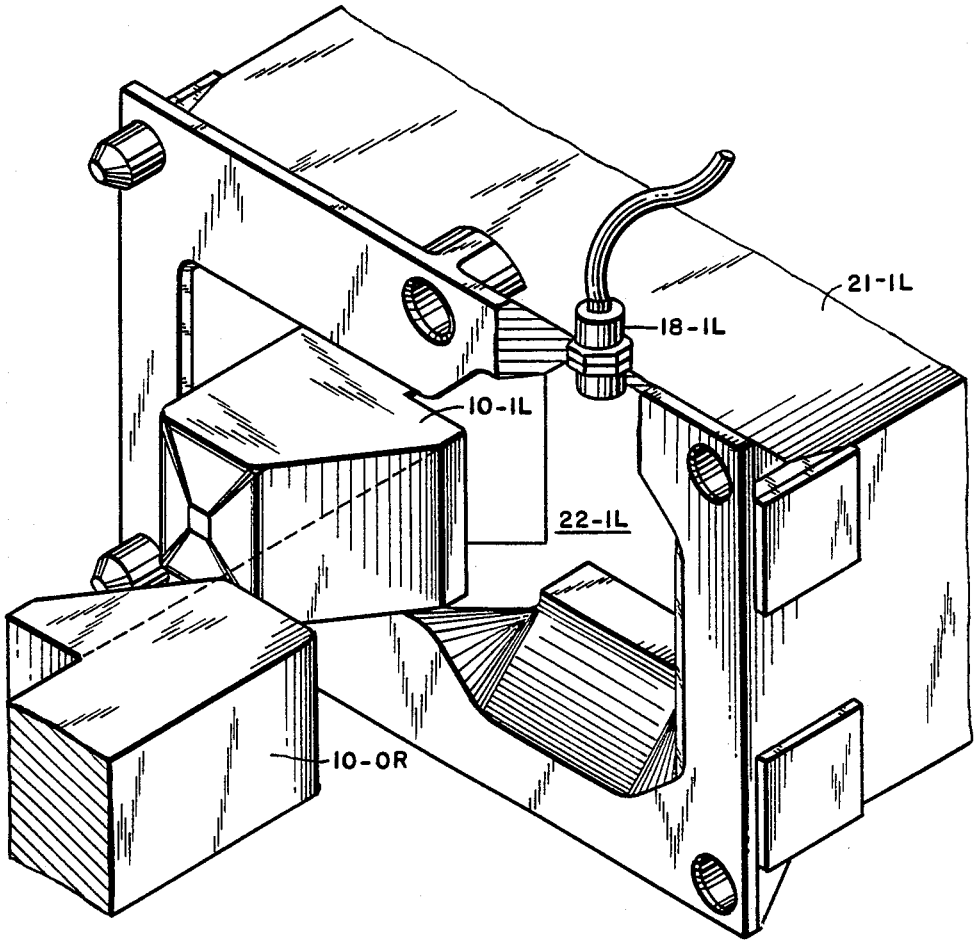
FIG. 1 is a perspective view illustrating a portion of the mechanical coupling elements of two railway vehicles as well as the placement of a sensor switch according to the present invention.
Figure 2:
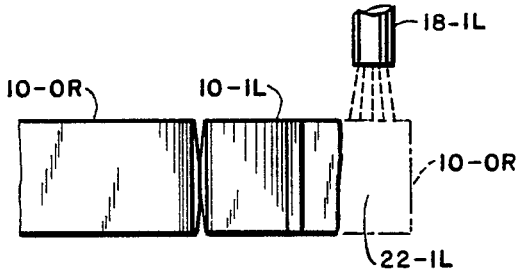
FIG. 2 is a side elevational view of the mating mechanical coupler hooks of FIG. 1 together with a portion of the sensor switch.
Figure 3:
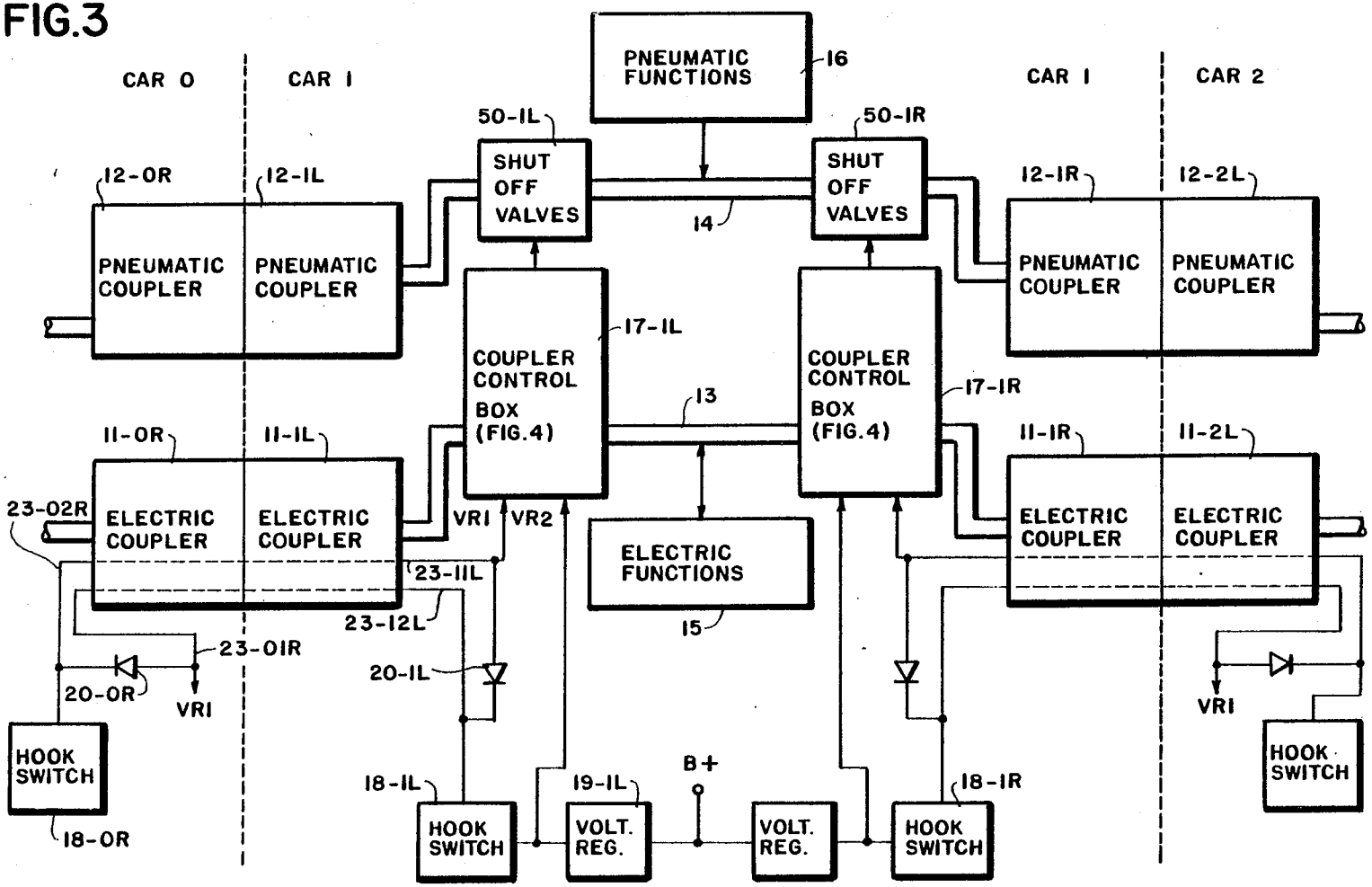
FIG. 3 is a block diagram of a coupling system embodying the present invention.

With reference now to FIGS. 1 to 3, a coulping system embodying the invention is illustrated for three railway vehicles or cars identified by dashed lines in FIG. 3 as Car 0, Car 1, and Car 2, it being understood that there could be a lesser or greater number of cars coupled in a train. Since the coupling system for each of the cars is identical, only the coupling elements for car 1 are illustrated in detail with selected elements from Cars 0 and 2 being shown for clarity. Structural elements that are identical in FIG. 1–3 but located in different cars are identified by the numerical suffix 0,1 or 2 for Cars 0, 1 or 2 respectively. For the most part, the ensuing description will be directed to the coupling system elements found in Car 1.

The coupling system for each vehicle includes at each end a mechanical coupling element 10-1 (FIG. 1), an electric coupling element 11-1 (FIG. 3) and a pneumatic coupling element 12-1 (FIG. 3). In FIG. 3 the electric and pneumatic elements are further distinguished by the letters L for the left-hand end of the car and R for the right-hand end of the car. Thus, when coupled, the left-hand couplers 11-1L and 12-1L of car 1 mate with right-hand couplers 11-OR and 12-OR of Car 0. On the other hand, the right-hand couplers of 11-1R and 12-1R of Car 1 mate with the left-hand couplers 11-2L and 12-2L of Car 2.

The electric couplers include the necessary electric connectors to interconnect the electric lines 13 of the cars while the pneumatic couplers include the necessary pneumatic connectors to interconnect the pneumatic lines 14 of the cars. Onboard electric functions 15 are interconnected with the electric lines 13 and onboard pneumatic functions 16 are interconnected with the pneumatic lines 14. These functions include, for example, electric lights, warning systems, air brakes and the like.

Car 1 includes a pair of coupler control boxes 17-1L and 17-1R which are arranged to isolate the electric lines and functions from the electric coupler interfaces 11 and to control the isolation of the pneumatic lines from the pneumatic coupler interfaces 12 when Car 1 is uncoupled from either Car 0 or Car 2, as the case may be. Thus, coupler control box 17-1L provides the isolation function between electric lines 13 and the electric coupler interface 11-1L. Coupler control box 17-1L further provides a control signal to pneumatic shut off valves 50-1L to control isolation of pneumatic lines 14 from the pneumatic coupler 12-1L. On the other hand, coupler control box 17-1R provides isolation between the lines 13 and 14 and electric and pneumatic coupler interfaces 11-1R. Coupler control box 17-1R further provides a control signal to pneumatic shut off valves 50-1R to control isolation of pneumatic lines 14 from pneumatic coupler 12-1R.

An important feature of the present invention is the provision of a hook switch 18-1L or 18-1R that serves to connect the onboard battery power B+to the corresponding coupler control box for initiation of a coupling operation only when Car 1 is actually coupled to Car 0 or Car 2, as the case may be. To accomplish this, hook switch 18-1L is of a metal detector type that is located in the mechanical element structure so as to detect the mating mechanical hook element of an adjacent car only when in the coupled position. To this end, hook switch 18-1L is illustrated in FIG. 1 as being positioned in the mechanical hook element housing structure 21-1L above the space 22-1L into which the mating mechanical hook 10-0R of Car 0 will enter during a coupling operation. The switch itself is a combination inductive proximity sensor and switch that has a reactance which changes as metal enters its effective range. In one design embodying the present invention, the sensor and switch element 18 is a Series 90 Proximity Sensor available from Micro Switch of Freeport, IL.

In the side elevational view of FIG. 2, mechanical hook element 10-0R of Car 0 is illustrated in two positions. In the first position, indicated by the solid lines, it is partially within the space 22-1L and outside the effective range of the switch 18-1L. In the second position, indicated by the dashed lines the hook element 10-0R is fully within the space 22-1L and in mechanical engagement with hook 10-1L of Car 1. In this position, hook element 10-0R is within the effective range of the sensor switch 18-1L. The reactance of the switch will change and provide a closed electric circuit.

Referring once again to FIG. 3, the hook switch 18-1L is connected electrically in series with the onboard battery B+, voltage regulator 19-1L and diode 20-OR of Car 0. With hook switch 18-1L closed (Cars -0 and 1 coupled together), this circuit will apply the regulated voltage VR1 to coupler control box 17-1L. This voltage VRI is used by the coupler control box to initiate a coupling cycle. The output voltage VR2 of voltage regulator 19-1L is also applied to coupler box 17-1L to provide a power supply for the circuits therein.

Another important feature of the invention is the circuitry involving the diodes 20-1L and 20-OR. This circuitry provides isolation of the voltage VRI from its associated coupler control box when the associated car is uncoupled and uses only two connector pins per electric coupler. This is accomplished by routing the Car 1 voltage of VR1 signal from hook switch 18-1L via lead 23-12L and electric coupler 11-1L to a loop on Car 0 where it is looped back through coupler 11-0R to coupler 11-1L and then via lead 23 11L to the coupler control box 17-1L. The loop on Car 0 includes lead 23-01R, diode 20-0R and lead 23-02R. In this circuit, the lead functions on either side of the electric coupler interface are reversed. Thus, lead 23-11L (Car 1) is connected via couplers 11-1L and 11-0R to lead 23-02R on the Car 0 side. Similarly, lead 23-12L (Car 1 side) is connected via the electric couplers to lead 23-01R on the Car 0 side. These connections together with the illustrated diode polarities assure isolation of the VR1 signal from the coupler control boxes for the case where adjacent cars are uncoupled. Similar circuit connections are provided at the other ends of Cars 0 and 1 to interface in like manner with adjacent cars, as shown, for example, at the interface of Cars 1 and 2 in FIG. 3.

Figure 4:
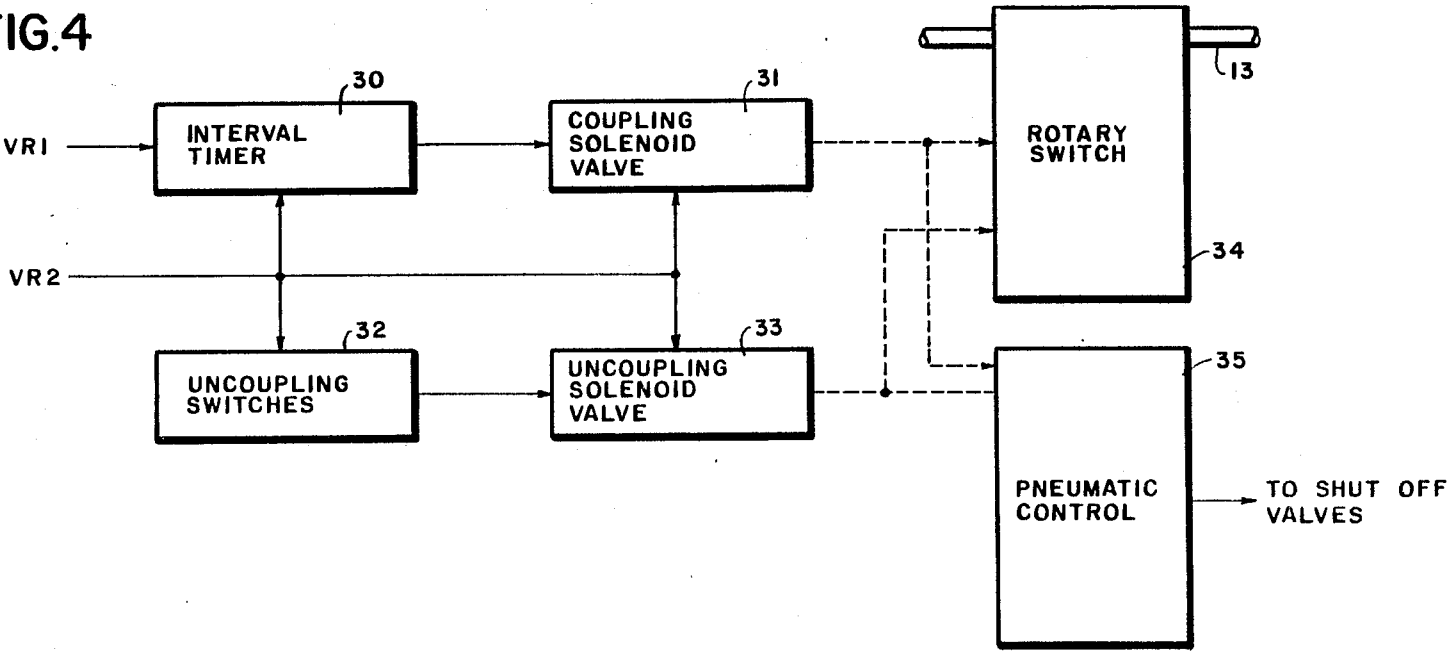
FIG. 4 is a block diagram of the coupler control box of FIG. 3.

FIG. 4 illustrates a coupler control box. The regulated voltage VR2 is used as a power supply for an interval timer 30, coupling solenoid valve 31, uncoupling switches 32 and uncoupling solenoid valve 33.

The interval timer 30 is responsive to the leading edge of the VR1 signal to generate (after a suitable delay to allow for false signals) a coupling cycle signal (of say, 15 seconds in duration) which serves to operate a coupling solenoid valve 31. The coupling solenoid valve 31 in operable in response thereto to operate rotary switch 34 from an open to a closed position so as to connect the onboard electric lines 13 in circuit with the associated electric coupler interface so as to provide electric continuity with the adjacent or mating car in the coupling operation. Coupling solenoid valve 31 is also operable to cause pneumatic control 35 to actuate the pneumatic shut off valves 50-1L or 50-1R, as the case may be, resulting in the coupling of the onboard pneumatic lines 14 to the associated pneumatic coupler to thereby provide pneumatic continuity with the adjacent or mating car in the coupling operation. Generally, these FIG. 4 components are known elements functioning in a known manner and form no part of the present invention except as described below and illustrated in FIG. 5. Accordingly, they will not be described further.

Figure 5:
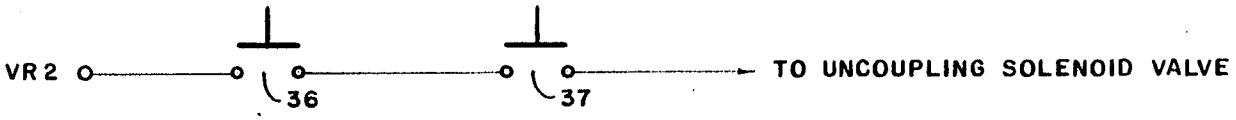
FIG. 5 is a schematic circuit diagram of circuitry for one of the uncoupling switch operations of FIG. 4.

In accordance with another feature of the invention, the uncoupling switches of FIG. 4 include the FIG. 5 series connected switches arranged to assure that the pin connectors of the associated electric coupler interface will not be hot when the associated car end is uncoupled. Thus, the FIG. 5 circuit includes switch 36 which is closed when the associated car end is uncoupled and switch 37 which is closed when the associated rotary switch is closed. This assures that when a car end is uncoupled, the uncoupling solenoid valve will be automatically operated to disconnect the onboard electric and pneumatic lines for the associated electric and pneumatic coupler interfaces of that car end. The switch 37 may essentially be one of the contact positions of the rotary switch 34. The switch 36 is associated with the electric coupling elements of the electric coupler. (The switch consists of two coupler contacts, one fixed and one moveable, connected by a moveable contact bar when the electric portion is uncoupled. When coupled, the contact bar physically moves to break the connection between the two contacts.)

Figure 6:
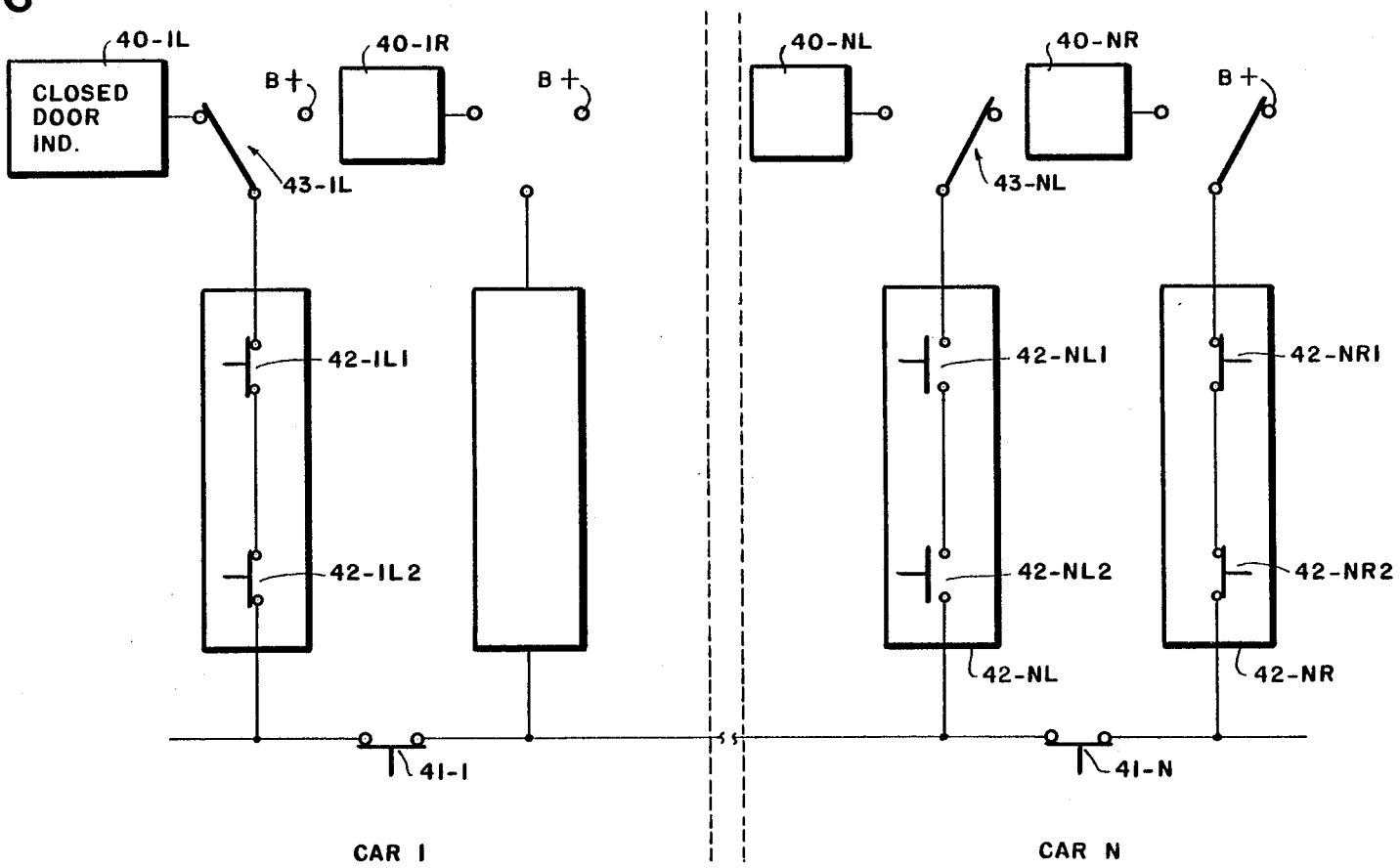
FIG. 6 is a block diagram in part and a circuit diagram in part of a loop test circuit extending along the train in accordance with another feature of the invention.

Still another feature of the invention in the FIG. 6 circuit that serves to isolate onboard battery power of any car from a test loop distributed among the cars of an N Car train. The test loop illustrated in FIG. 6 may, for instance, be testing for closed doors in Cars 1 through N and, Car 1 being the lead car and Car N the trailing car. If all doors are closed, the train can safely start motion.

Each car is provided at each of its ends with a switch pair 42, a closed door indictor 40 and a switch 43 arranged to connect the associated switch pair in series with either the closed door indicator or B+. The test loop includes in a series circuit the closed door indicator 40-1L of Car 1 (the lead car), the switch contact 43-1L, the switch pair 42-1L1 and 42-1L2 in and closed door switches 41-1 . . . 41-N and the battery power of the trailing end of Car N. Thus, if all doors are closed the closed door indicator in Car 1 will yield a closed door signal signifying that the train can safely start motion.

FIG. 6 illustrates that the battery power of the individual cars is adapted for connection in circuit to either side of the associated closed door switch via the associated switch pairs 42. Thus, Car N has a left-hand circuit 42-NL and a right-hand circuit 42-NR on the respective sides of switch 41-N. Each such circuit includes a pair of series connected switches. Thus, circuit 42-NR includes switches 32-NR1 and 42-NR2, both being illustrated in the closed position. Switch 42-NR-1 is closed when the associated rotary switch (34 in FIG. 4) is open and switch 42-NR2 is closed when the associated car end is uncoupled. Both of these conditions prevail for the right-hand end of Car N since it is the last or trailing car in the train. These same conditions prevail for the left-hand end of Car 1 such that switches 41-1L1 and 41-1L2 are also illustrated in the closed position.

On the other hand, all the remaining switch pairs on the train car will be open since their associated car ends are in a coupled condition as illustrated for switches 42-NL1 and 42-NL2 of Car N. This assures that the test loop will test continuity of the entire loop and not just a part thereof as would be the case if battery power from one of the intermediate cars was not isolated from the test loop.

In the preceeding description description of the preferred embodiment, it is evident that the objects of the present invention are attained and that a new coupling system is provided that provides effective isolation of the electric and pneumatic lines of a rail vehicle from its corresponding electric and/or pneumatic intervehicle coupling interfaces as well as from its corresponding battery when required. Although the invention has been described and illustrated in detail, it is clearly understood that the same is by way of illustration and example only and is not to be taken by way of limitation. The spirit and scope of the present invention are to be limited only by the terms of the appended claims.

What is claimed is:

1. In an electric coupling system for at least two railway vehicles in which each vehicle has a first electric line adapted for coupling to a battery and a second electric line adapted for connection to electric circuits, and an electric coupling element that interconnects the lines of the two vehicles when they are coupled; the improvement comprising:

electric isolation means for each vehicle for isolating the battery of each vehicle from its corresponding second line and electric circuits when the two vehicles are uncoupled while providing electric continuity therebetween when the two vehicles are coupled, such isolation means comprising a diode connected between the corresponding first and second lines with a polarity to isolate the battery from its corresponding second line; and the electric coupling elements of the two vehicles mating in the coupled condition to provide a connection of the first and second lines of a first of the vehicles with the second and first lines, respectively, of the second of the vehicles, whereby upon coupling the battery of the first vehicle is coupled in a first circuit with its corresponding second line via the two electric coupling elements and the second line and diode of the second vehicle.

2. The invention according to claim 1 wherein upon coupling the battery of the second vehicle is coupled in a second circuit with its corresponding second line via the two electric coupling elements and the second line and diode of the first vehicle; and wherein the electric isolation means of the first and second vehicles further includes a switch which is operative in the coupled and decoupled conditions of the two vehicles to provide connect and disconnect operations of the batteries of the first and second vehicles in the first and second circuits, respectively.

3. The invention according to claim 2 wherein each such vehicle has a mechanical coupling element for mechanically coupling the two vehicles together;

wherein the electric coupling elements of the two vehicles become coupled to one another during the mechanical coupling process; and wherein each such switch is a sensor switch which is positioned to sense actual engagement of the mechanical elements and to provide the connect operations after a delay that allows the electric coupling elements to come into good electric contact.

4. The invention according to claim 3 wherein the sensor switch is a combination inductive sensor and switch.

* * * * *